US008069784B2

(12) United States Patent
Gerner et al.

(10) Patent No.: US 8,069,784 B2
(45) Date of Patent: Dec. 6, 2011

(54) DEVICE IN A PRINTING UNIT OF A PRINTING MACHINE

(75) Inventors: Erich Max Karl Gerner, Bütthard (DE); Bernhard Wilhelm Ernst, Veitshöchheim (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 12/736,775

(22) PCT Filed: Jan. 26, 2009

(86) PCT No.: PCT/DE2009/050004

§ 371 (c)(1),
(2), (4) Date: Nov. 8, 2010

(87) PCT Pub. No.: WO2009/140958

PCT Pub. Date: Nov. 26, 2009

(65) Prior Publication Data

US 2011/0107929 A1 May 12, 2011

(30) Foreign Application Priority Data

May 19, 2008 (DE) ..... 10 2008 001 848

(51) Int. Cl.
*B41F 31/00* (2006.01)
*B41F 31/15* (2006.01)
*F16D 27/01* (2006.01)

(52) U.S. Cl. ..... 101/216; 101/352.06; 310/103; 310/191

(58) Field of Classification Search ..... 101/216, 101/480, 352.06, 350.3, 350.6; 310/103, 310/191; 403/DIG. 1; 464/29; *H02K 7/05; B41F 31/00, 31/15; F16D 27/00, 27/01*
See application file for complete search history.

(56) References Cited

U.S. PATENT DOCUMENTS

| | | | | |
|---|---|---|---|---|
| 6,354,202 | B1 * | 3/2002 | Heiler | 101/148 |
| 7,121,205 | B2 * | 10/2006 | Ono et al. | 101/480 |
| 2007/0039496 | A1 | 2/2007 | Sieber et al. | |
| 2007/0234911 | A1 * | 10/2007 | Schafer et al. | 101/177 |
| 2009/0272284 | A1 | 11/2009 | Schneider et al. | |

FOREIGN PATENT DOCUMENTS

| | | | |
|---|---|---|---|
| DE | 1 233 416 | | 2/1967 |
| DE | 39 17 074 | A1 | 5/1990 |
| DE | 101 61 889 | A1 | 9/2002 |
| DE | 102 19 903 | A1 | 11/2003 |
| DE | 10 2005 061 028 | A1 | 3/2007 |
| DE | 102005061028 | A1 * | 3/2007 |
| DE | 100 2006 007 581 | A1 | 8/2007 |

(Continued)

*Primary Examiner* — Ren Yan
*Assistant Examiner* — Jennifer Simmons
(74) *Attorney, Agent, or Firm* — Mattingly & Malur, P.C.

(57) ABSTRACT

A device for use in a printing unit of a printing machine, with that printing unit comprising at least one roller of an inking unit or of a dampening unit of the printing unit and with at least one traverse drive for generating an axial traversing stroke of the roller, and also with at least one drive for the moving of the roller in a rotary manner. A magnetic coupling, which is comprised of an inner rotor and an outer rotor, is arranged between the roller and the drive. In order to compensate for the traversing stroke of the roller, the inner rotor and the outer rotor are movable relative to each other in the direction of the axis of rotation of the roller.

21 Claims, 7 Drawing Sheets

FOREIGN PATENT DOCUMENTS

| | | | | |
|---|---|---|---|---|
| DE | 102006007581 | A1 | * | 8/2007 |
| EP | 1 820 648 | A2 | | 8/2007 |
| WO | 2005/007410 | A2 | | 1/2005 |
| WO | 2007/093576 | A9 | | 8/2007 |
| WO | 2007/135155 | A2 | | 11/2007 |

* cited by examiner

DEVICE IN A PRINTING UNIT OF A PRINTING MACHINE

CROSS-REFERENCE TO RELATED APPLICATIONS

This application is the U.S. national phase, under 35 U.S.C. 371, of PCT/DE2009/050004, filed Jan. 26, 2009; published as WO 2009/140958 A2 and A3 on Nov. 26, 2009, and claiming priority to DE 10 2008 001 848.1, filed May 19, 2008, the disclosures of which are expressly incorporated herein by reference.

FIELD OF THE INVENTION

The present invention is directed to a device in a printing couple of a printing press. The printing couple of the printing press includes at least one roller of an inking unit or of a dampening unit. An oscillating drive is usable to generate an axial oscillating stroke of the at least one roller. A drive is provided for generating a rotational movement of the roller.

BACKGROUND OF THE INVENTION

WO 2007/135155 A2 describes assemblies in a printing couple of a rotary printing press. Each such assembly is comprised of at least one forme cylinder, three ink forme rollers, two distribution rollers, and one ink flow dividing roller. Both of the distribution rollers are engaged directly against the ink flow dividing roller. One of the ink forme rollers is engaged against one of the distribution rollers and against the forme cylinder. The other two ink forme rollers are engaged against the distribution roller and against the forme cylinder. The forme cylinder is covered with a plurality of printing formes. The dampening unit of the printing couple includes a smoothing roller which executes an oscillating stroke in the axial direction of the roller. The oscillating stroke of the smoothing roller can be generated by a stand-alone drive. Alternatively, the generation of the oscillating stroke of the smoothing roller can be coupled to the drive for rotating the smoothing roller. In that case, the oscillating stroke of the smoothing roller is derived from the rotational motion by the use of a transmission.

WO 2005/007410 A2 describes a roller of an inking or dampening unit, which has both a separate motorized drive, that is embodied as a drive motor, and an oscillating drive. The roller is mounted on a spherical bushing, which is connected to the motor shaft of the drive motor through the use of an angle or bevel gear transmission, an angle compensating coupling, and a shaft, and which transmits torque. Such a mounting permits the transmission of rotational movement, while still allowing the roller to oscillate axially relative to the shaft. The balls of the spherical bushing run in longitudinal grooves in both the shaft and the bearing body. This allows torque to be transmitted, while allowing the bearing body to move axially relative to the shaft.

DE 101 61 889 A1 describes an inking unit of a printing press with an ink distribution roller. The ink distribution roller is connected to a drive motor by a magnetic coupling utilizing permanent magnets. The two coupling halves of the magnetic coupling are not able to move relative to one another in the direction of the rotational axis of the ink distribution roller.

DE 39 17 074 A1 and DE 1 233 416 B both disclose the use of electromagnetic clutches in inking units. A compensation for an oscillating stroke within the clutch is not suggested.

DE 10 2006 007 581 A1 describes an oscillating drive of a cylinder of a printing press, and which has a torque motor for rotationally driving the printing press cylinder. The rotor of the torque motor is rigidly connected to a journal of the printing press cylinder. Oscillating motion is enabled by the provision of a journal extension that extends beyond the torque motor, and with which journal extension a linear drive engages.

SUMMARY OF THE INVENTION

The problem which is addressed by the present invention is that of providing a device in a printing couple of a printing press, in which device an oscillating stroke of a roller is compensated for, without wear and tear, and with low maintenance.

The problem is solved, in accordance with the present invention by the provision of the drive assembly for generating a rotational movement of the roller in the inking unit or dampening unit of the printing couple as an electric motor or as an electric motor or including an electric motor. A magnetic coupling comprised of an inner rotor and an outer rotor is arranged between the roller and the drive assembly. The inner rotor and the outer rotor are capable of moving relative to one another in the direction of the rotational axis of the roller. This compensates for the oscillating stroke of the roller The benefits to be achieved by the present invention consist especially in that the oscillating stroke of the roller is compensated for in a contactless fashion. This is due to the presence of a magnetic bearing or a magnetic coupling. The device of the present invention is therefore free from wear and tear and requires low maintenance.

A further benefit is provided, in accordance with the present invention, by the ease of assembly or production of the device. This is because comparatively complex and thus sensitive components can be dispensed with. In the simplest case, a magnetic bearing or a magnetic coupling consists of two components, namely the outer rotor and the inner rotor, which two component construction enables a relatively simple production and assembly of the device.

BRIEF DESCRIPTION OF THE DRAWINGS

A preferred embodiment of the present invention is depicted in the set of drawings and will be specified in greater detail in what follows.

The drawings show.

DESCRIPTION OF THE PREFERRED EMBODIMENT

Figure 1:
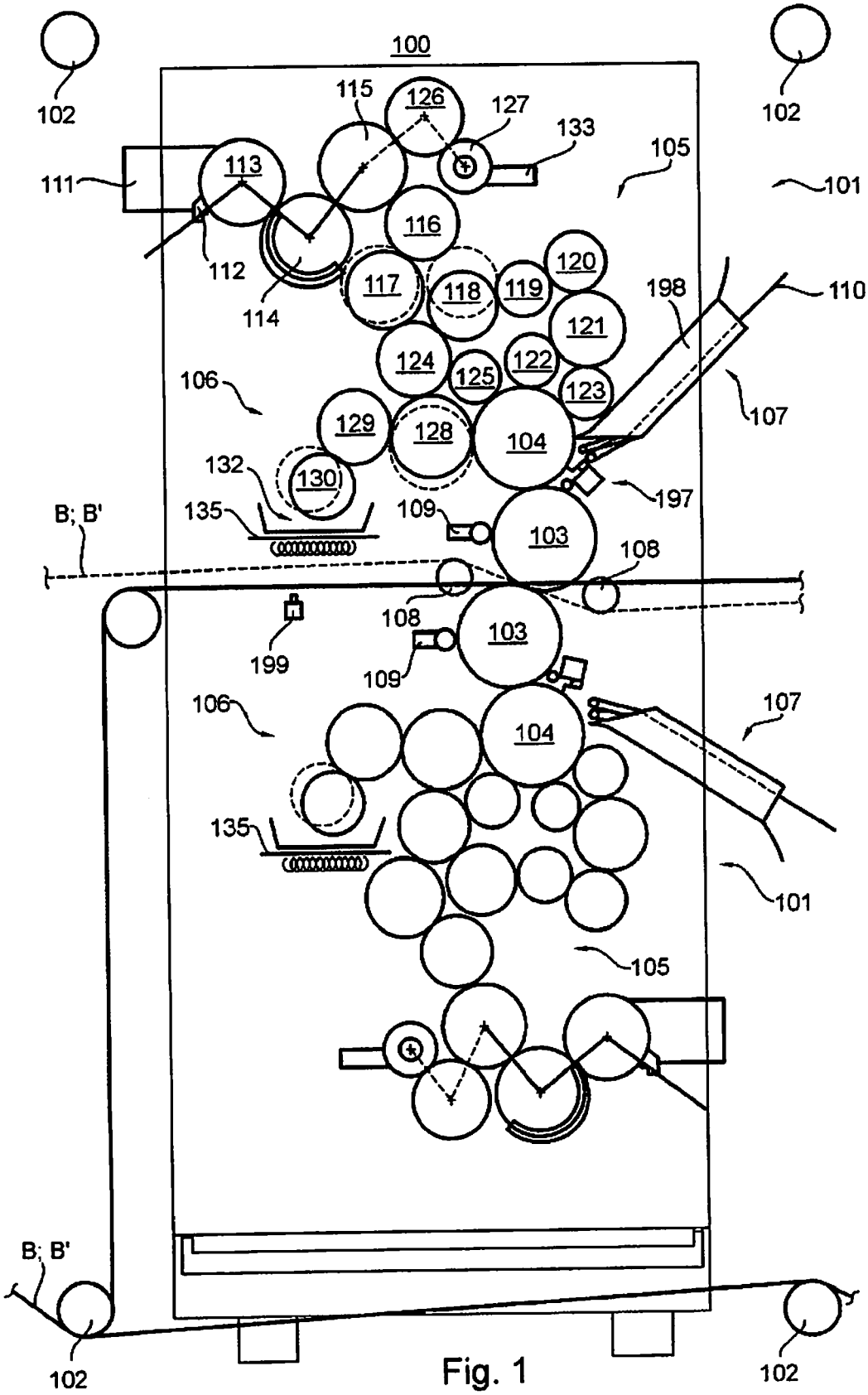
FIG. 1 a schematic illustration of a printing unit from a side view.

FIG. 1 shows a schematic illustration of a printing unit 100 of a printing press. Printing presses of this type have at least one printing unit 100, and preferably have at least four or even five such printing units 100 of the type depicted in FIG. 1. A print substrate B; B', which is preferably a material web B; B', and particularly is a paper web B; B', which will be referred to as web B; B', is reeled off of a reel unwinding unit and is then fed, by an infeed unit, to the printing units 100. The printing units 100 are preferably arranged side by side, and the web B; B' which, as is also shown in FIG. 1, passes through these printing units 100 horizontally. In addition to the multiple printing units 100, which are customarily provided for multicolor printing, additional printing units can be provided. These can then be used alternatingly with one or more of the other printing units 100, to enable a flying printing forme change, for example.

The printing unit 100 is preferably embodied as a printing unit 100 for offset printing, and is particularly configured as a blanket-to-blanket printing unit 100 or as an I-type printing unit 100. It uses two printing couples 101, such as, for example, two offset printing couples 101 for double-sided printing in a so-called blanket-to-blanket print operation.

At least one of the printing units 100 is situated upstream of, and at least one similar printing unit 100 is situated downstream of rollers 102, which rollers 102 are positioned at least in the lower area of each printing unit 100, and optionally are also positioned in the upper area of the printing unit. By use of these rollers, an incoming web B; B' can be guided around the printing unit 100 at the top or the bottom of the respective printing unit. A web B; B' that has been guided around an upstream printing unit 100 can be guided through the following, downstream printing unit 100, or a web B; B' that has been guided through the upstream printing unit 100 can be guided around the downstream printing unit 100.

In the embodiment of the present invention, which is shown in FIG. 1, the printing unit 100 is configured with two printing couples 101 which cooperate to print the web B; B'. Each of the printing couples 101 comprises printing couple cylinders 103; 104, one of which is embodied as transfer cylinder 103 and the other of which is embodied as forme cylinder 104, referred to, in short, as cylinder 103; 104, along with an inking unit 105 and a dampening unit 106. In the embodiment shown in FIG. 1, each forme cylinder 104 of the printing unit 100 is equipped with a device 107 for use in accomplishing either semiautomatic or fully automatic plate loading or for changing printing formes 110, which are typically embodied as flexible printing plates 110.

The plate loading and/or changing device 107 is embodied as having two parts. It has a nip device 197 or a "semiautomatic forme changing apparatus" 197, which is situated in the area of a nip point between the forme cylinder 104 and the transfer cylinder 103. The plate loading and/or changing device 107 further comprises a loader 198 with apparatuses for infeeding and for receiving printing formes 110, which loader 198 is structurally separate from the nip device.

In particular, if the printing unit 100 is to be configured for imprinting operation, it is equipped with additional guide elements 108 that are located a short distance upstream and downstream of the nip point of the printing unit 100. When the printing unit 100 will be traversed without imprinting and without contact between web B; B' and transfer cylinders 103, the web path, which is indicated by a dashed line in FIG. 1, and which utilizes guide elements 108, is selected. Such a web path is characterized in that the web B; B' passes through the nip point in such a way that it essentially forms an angle of 80° to 100°, and preferably forms for example, an angle of about 90°, with respect to a line of connection between the rotational axes of the two transfer cylinders 103. The guide elements 108 are preferably embodied as rods or as rollers about which air can flow. Such guide elements 108 serve to diminish the risk of smearing of freshly printed inks.

The reference number 109 shown in FIG. 1 identifies a washing device, one of which washing devices 109 is assigned to each of the transfer cylinders 103. Each such washing device 109 is used to clean the elastic surface of its associated transfer cylinder 103.

Each of the transfer cylinders and forme cylinders 103; 104 typically has a circumference of between 540 and 700 mm, and preferably has a circumference between 540 and 630 mm. The forme cylinder 104 and the transfer cylinder 103 preferably each have the same circumference. Cylinders 103; 104 having different circumferences, for example, having a circumference of 546 mm, 578 mm, 590 mm, or 620 mm, may optionally be used. This is made possible, for example, by exchanging bearing elements or by adjusting the position of the bored holes in the side frame for the cylinders 103; 104 and by adjusting the location of the drive for the cylinders.

Each of the transfer cylinders 103 has at least one blanket or packing, which is not specifically shown in FIG. 1, on its outer surface. Such a blanket or packing is preferably configured as a metal printing blanket, which has an elastic layer, such as, for example, rubber on an essentially dimensionally stable support layer. The support layer can be embodied in the form of a thin metal plate, for example. The packing preferably extends over the effective length or essentially over the entire intended printing width of the web B; B', and essentially, except up to a butt joint or to a channel opening, about the entire circumference of the transfer cylinder 103.

For use in accomplishing the fastening of the packing or blanket on the transfer cylinder 103, that cylinder has a groove extending axially on its outer surface, which groove extends over the entire usable width of the transfer cylinder 103. The width of the groove opening, in the area of the outer surface of cylinder 103, is preferably 1 to 5 mm, and is particularly less than or equal to 3 mm, in the circumferential direction of the cylinder 103. The ends of the packing or blanket are inserted into the groove through an opening in the outer surface of the transfer cylinder 103, and are held in place there in a frictional connection and/or in a positive connection by the use of a latch mechanism, a clamp, or a chucking device, as is generally known in the art. In the case of a metal printing blanket, the ends are bent or angled, such as, for example, approximately 45° at the blanket leading end and by approximately 135° at the blanket trailing end. Clamping is preferably pneumatically actuable, for example, and is provided in the form of one or more pneumatically actuable levers, which, when closed, are prestressed, by the provision of a spring force, against the blanket trailing end which extends into the groove. A hose that can be pressurized with pressure medium can preferably be used as the actuating means.

The reference number 105 identifies the inking unit. In addition to an ink delivery system, such as a blade bar or an ink fountain 111 with an adjustment device 112 for regulating ink flow, the inking unit has, for example, a plurality of ink rollers 113 to 125. When these ink rollers 113 to 125 are engaged against one another, the ink travels from ink fountain 111 by way of an ink fountain roller 113, an ink film roller 114, and a first inking roller 115 to a first ink distribution cylinder 116. From there, depending upon the operating mode of the inking unit 15, the ink travels over at least one or more additional inking rollers 117 to 120 to at least one additional ink distribution cylinder 121; 124. From that at least one distribution cylinder 121; 124, the ink travels over ink forme rollers 122; 123; 125 to the surface of the forme cylinder 104.

In one advantageous embodiment, the ink travels alternately or simultaneously, in series or in parallel, and by different possible paths, from the first distribution cylinder 116 over two additional distribution cylinders 121; 124 to the forme rollers 122; 123; 125. This is shown in FIG. 1.

As FIG. 1 further shows, in an advantageous embodiment of the inking and dampening units 105; 106, the second or additional ink distribution cylinder 124 can cooperate simultaneously with a roller 128, such as, for example, with a dampening forme roller 128, of the dampening unit 106.

By the use of an ink splitting or ink removal roller 126 of the inking unit 105, ink can be removed from the inking unit 105 in the inking path, and particularly, such excess ink can be removed upstream of the first ink distribution cylinder 116. This is accomplished by engaging a suitable ink removal device 133 against the ink splitting or removal roller 126 itself or, as is shown in FIG. 1, by engaging the ink removal device 133 against a roller 127 that cooperates with the ink splitting or removal roller 126.

Referring again to FIG. 1, the dampening unit 106 has the dampening forme roller 128 and also has an additional dampening fluid distribution roller 129 which cooperates with the dampening forme roller 128. Dampening fluid distribution roller 129 can be embodied particularly as an oscillating chromium roller 129. Roller 129 receives the dampening agent from a dampening device, which can be embodied, for example, in the form of a dampening unit roller 130. The dampening unit roller 130 can be embodied as a dipping roller 130, which dips into a dampening agent reservoir 132, such as, for example, a water fountain. A drop sheet 135, that is usable for catching condensation water that forms on the water or dampening fluid fountain, is preferably arranged beneath the water or dampening fluid fountain. In one advantageous embodiment, the drop sheet 135 can be heated, for example, by using heating coils.

The dampening fluid distribution roller 129 and the dipping roller 130 are each driven by a separate rotational drive, which is not specifically shown, and particularly each by a separate drive motor, for example. Each such drive motor can rotationally drive its one of the respective rollers 129; 130 separately, mechanically independently of one another, by the use of an angle transmission or a bevel gear transmission. Each such drive motor is preferably embodied as a speed-controlled, and particularly as a continuously speed controlled electric motor, and even more particularly as a three-phase alternating current motor. The motor speeds and/or the dampening fluid distribution rate can advantageously be adjusted at a printing press control panel, such as, for example, at a printing press ink control panel, where they are also displayed. In one preferred embodiment, the machine is controlled on the basis of a correlation between machine speed and dampening or rotational speed, which can be used to preset the speed of the two rollers 129; 130, particularly of the dampening fluid dipping roller 130, that is to be regulated.

As is further shown in FIG. 1, in one advantageous embodiment the inking rollers 117 and 118 and the dampening forme roller 128 are each capable of moving, each between their alternative positions, as indicated by solid and dashed lines. This refers to the operational movability of the rollers 117; 118; 128 between different operating positions and not to the movability of the rollers 117; 118; 128 for purposes of adjustment. To shift the rollers 117; 118; 128 from one operating position to the other, positioning assemblies and/or stops such as, for example, adjustable stops, which can be actuated manually or by the use of drives, can be provided, for both of the operational settings. In addition, either a greater adjustment path is allowed, or the roller arrangement is selected such that the two positions can be achieved by the customary adjustment path.

To allow the position of the dampening forme roller 128 to be changed, in one advantageous embodiment, chromium dampening fluid distribution roller 129 and dampening fluid dipping roller 130 are mounted so as to be movable in a direction which is perpendicular to their respective axes of rotation. Such movement can be accomplished, for example, by having these rollers 129 and 130 mounted in levers.

Distribution cylinders 116; 121; 124 of the inking unit 105 and dampening fluid distribution roller 129 of the dampening unit 106 are mounted, at their ends, in spaced side frames or frame walls, which are not specifically shown, so as to be axially movable. Therefore, they are each able to execute an oscillating motion. The oscillating movement of the ink distribution cylinders 116; 121; 124 and of the dampening fluid distribution roller 129 is forced, for example, by the provision of an oscillating transmission that is coupled to the respective rotational drive for each one of the above-mentioned cylinders and roller.

A bearing, which permits oscillation, is also provided for the dampening forme roller 128 and for the ink forme roller 123. However, the axial oscillating movement of these rollers 128; 123 is effected, not by the provision of an oscillating transmission, but instead, is provided solely by friction with the cooperating cylindrical surfaces. Optionally, a bearing of this type, which has a degree of freedom in the axial direction, can also be provided for the two forme ink rollers 122 and 125.

The arrangement of the respective rollers and cylinders in the inking and dampening units 105; 106, as is indicated by solid lines in FIG. 1, shows the interaction of rollers 113 to 130 which is provided for "normal" print operation. Inking and dampening agent paths are connected to one another both by the second ink distribution cylinder 124 and also by the forme cylinder 104. Dampening of the forme cylinder 104 is thus implemented both directly and indirectly. The adjustability of dampening forme roller 128 makes it possible to choose between direct dampening in the "three-roller dampening unit" and, depending upon the position of the additional inking roller 117, indirect dampening or direct dampening in the "five-roller dampening unit."

The printing couple cylinders 103; 104 and the respective rollers and cylinders 113 to 130 of the inking and dampening units 105; 106 are each mounted at their end surfaces in or on frame walls, which end mountings are not shown in particular detail here.

Dampening fluid distribution roller 129 has, on its end surface which is opposite the rotational drive for this roller, an oscillating drive, which is not specifically shown in FIG. 1, and particularly has a transmission for use in generating an axial oscillating movement of roller 129 from the rotational movement of this same roller 129. In order to avoid the generation of frictional heat in localized spots along the length of the dampening fluid distribution roller 129, such a transmission is preferably situated outside of the roller body. In one advantageous embodiment of the present invention, this transmission is located on the drive side of the printing unit 100, or in other words, in the area of the same frame wall that holds the main drive, which main drive and its supporting frame wall is not shown in FIG. 1, and/or the same frame wall that holds a drive train for printing couple cylinders 103; 104. Preferably, the rotational drive for rollers 129 and 130 is located on the opposite side of the printing unit, or in other words, in the area of the other frame wall, which is also not specifically shown in FIG. 1.

The printing unit 100, as depicted generally in FIG. 1, is also equipped with a device 199 for influencing the fan-out effect, such as, for example, a device 199 for influencing a change in the transverse extension in the width of the web B; B' from print position to print position, which transverse or width extension may be caused, for example, by the printing process and particularly by the dampness. This device 199 for influencing the fan-out effect may be located in the intake area of the printing unit 100, or in the area of its infeed gap between the two transfer cylinders 103. The fan-out effect influencing device 199 can have an adjustment element which may be embodied as a nozzle, through which air can flow.

Driving of various ones of the cylinders and the rollers in the printing unit 100 is preferably implemented by the operation of a drive wheel, which is not specifically shown in FIG. 1. This drive wheel or gear is preferably driven by a main drive, such as, for example, by a stationary electric motor, and particularly by a torque angle controlled electric motor. The electric motor can be embodied as a water cooled motor. A drive wheel or gear of one of the two forme cylinders 104 is driven by an intermediate drive wheel or gear. Such a forme cylinder drive wheel or gear drives the drive wheel or gear of the transfer cylinder 103 to which that forme cylinder is assigned. The first transfer cylinder drive wheel or gear then drives the drive wheel or gear of the other transfer cylinder 103, which ultimately drives the drive wheel or gear of the second forme cylinder 104. The drive wheels or gears of the transfer cylinders 103 and forme cylinders 104 are non-rotatably connected to their respective cylinders 103; 104, such as, for example, by drive pins. Through the use of additional drive wheels or gears and intermediate wheels or gears, which are non-rotatably connected to the two forme cylinders 104 or to their drive gears, one or more of the rollers and cylinders 113 to 127 of the assigned inking unit 105 are rotationally driven.

Drive wheels or gears of the several ink distribution cylinders 116; 121; 124 are driven by at least one intermediate wheel or gear. The intermediate wheel or gear meshes with the drive wheel of one of the forme cylinders 104. Thus, in the illustrated embodiment, the respective ink distribution cylinders 116; 121; 124 are rotationally driven by forme cylinder 104 through a positive drive connection. The drive connections can be embodied so as to enable axial movement of the several ink distribution cylinders 116; 121; 124.

The ink fountain roller 113 has its own rotational drive, such as, for example, its own mechanically independent drive motor. Such a drive motor is not specifically shown in FIG. 1.

The remaining rollers 114; 115; 117 to 120; 122; 123 and 125 to 127 of the inking unit 105 are rotationally, and optionally axially driven solely by friction from their contact with the positively driven rollers and cylinders, as discussed above. The inking unit 105 or the ink distribution cylinders 116; 121; 124 are positively driven by the drive for the printing couple cylinders 103; 104.

Figure 2:
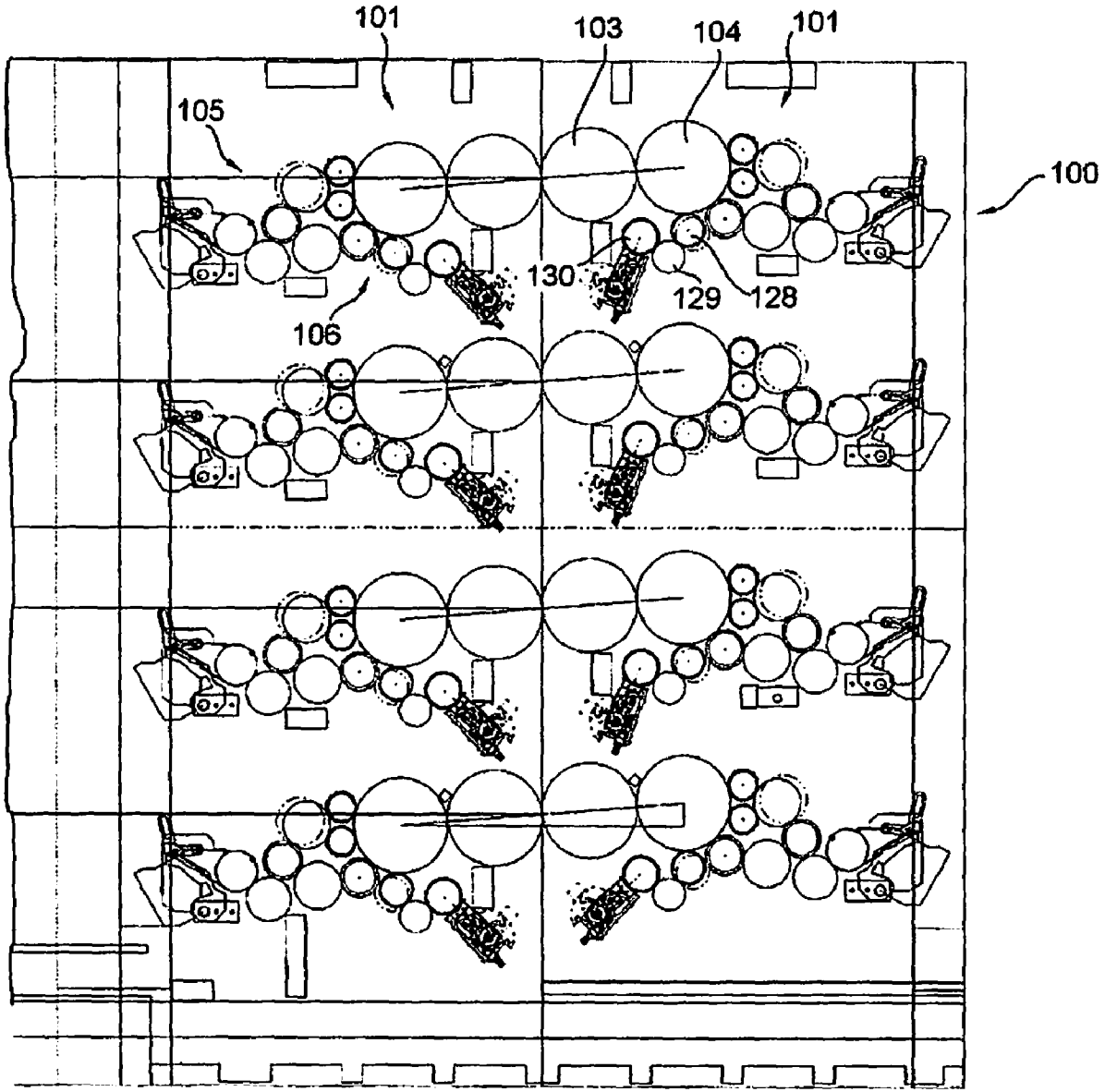
FIG. 2 a side elevation view of a printing tower of a printing press with a plurality of printing units.

FIG. 2 shows a schematic depiction of a printing tower with a plurality of printing units 100, such as, for example, with four such printing units 100, each consisting of two printing couples 101. The printing couples 101 each have two cooperating printing couple cylinders 103; 104, along with one inking unit 105 and one dampening unit 106 for each pair of printing couple cylinders 103; 104. In FIG. 2, for purposes of clarity, only rollers 128; 129; 130 of the dampening unit 106 are identified by reference symbols. Specifically, reference symbol 128 identifies the dampening forme roller, reference symbol 129 identifies the dampening distribution roller or the chromium roller, and reference symbol 130 identifies the dampening dipping roller, which picks up dampening agent from a dampening agent reservoir 132 and transfers it to the chromium dampening distribution roller 129.

As is shown in FIG. 2, the printing tower has two side frames, in which a plurality of printing couples 101, such as, for example, eight such printing couples 101, with each printing couple 101 comprising printing couple cylinders 103; 104, inking unit 105 and dampening unit 106, are arranged vertically, one above the other. In each case, two printing couples 101 form one blanket-to-blanket printing unit 100, with this arrangement enabling the embodiment of a printing tower that is suitable for four-color printing, for example. The print substrate B; B', which preferably is a material web B; B' and which is not specifically shown, is passed through the printing tower between the printing couple transfer cylinders 103 that are engaged against one another. The material web B; B' travels through the printing tower, preferably from bottom to top, and can be imprinted on both sides simultaneously. The printing tower shown in FIG. 2 can be a component of a newspaper printing press, for example.

Figure 3:
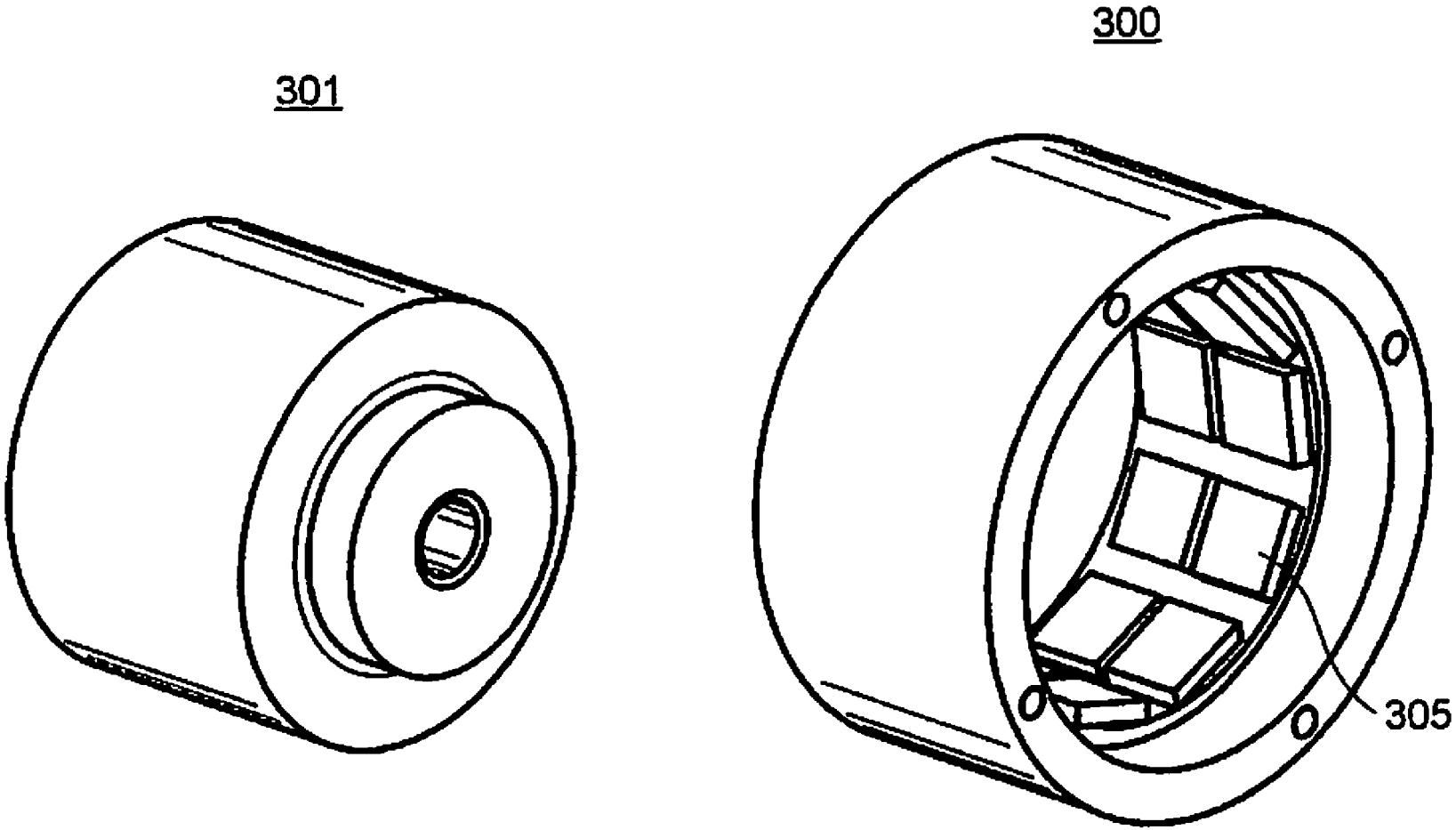
FIG. 3 an exploded perspective view of a magnetic coupling with an inner rotor and an outer rotor.

FIG. 3 shows an exploded perspective view of a magnetic coupling. The magnetic coupling comprises an outer rotor 300 and an inner rotor 301. The outer rotor 300 is loaded, on its interior side, and the inner rotor 301 is loaded, on its exterior side, with high-powered magnets 305; 306, particularly permanent magnets 305; 306 of alternating polarity. In the idle status of this magnetic coupling, the respective north and south poles of outer rotor 300 and inner rotor 301 are situated opposite one another. Twisting deflects the magnetic field lines, allowing torque to be transmitted through the air gap between the outer rotor 300 and the inner rotor 301. Synchronous operation is established under constant torsional play. The magnets of the outer rotor 300 are identified by reference symbol 305, the magnets 306 of the inner rotor 301 are not specifically shown in FIG. 3. They are shown in FIG. 4.

Figure 4:
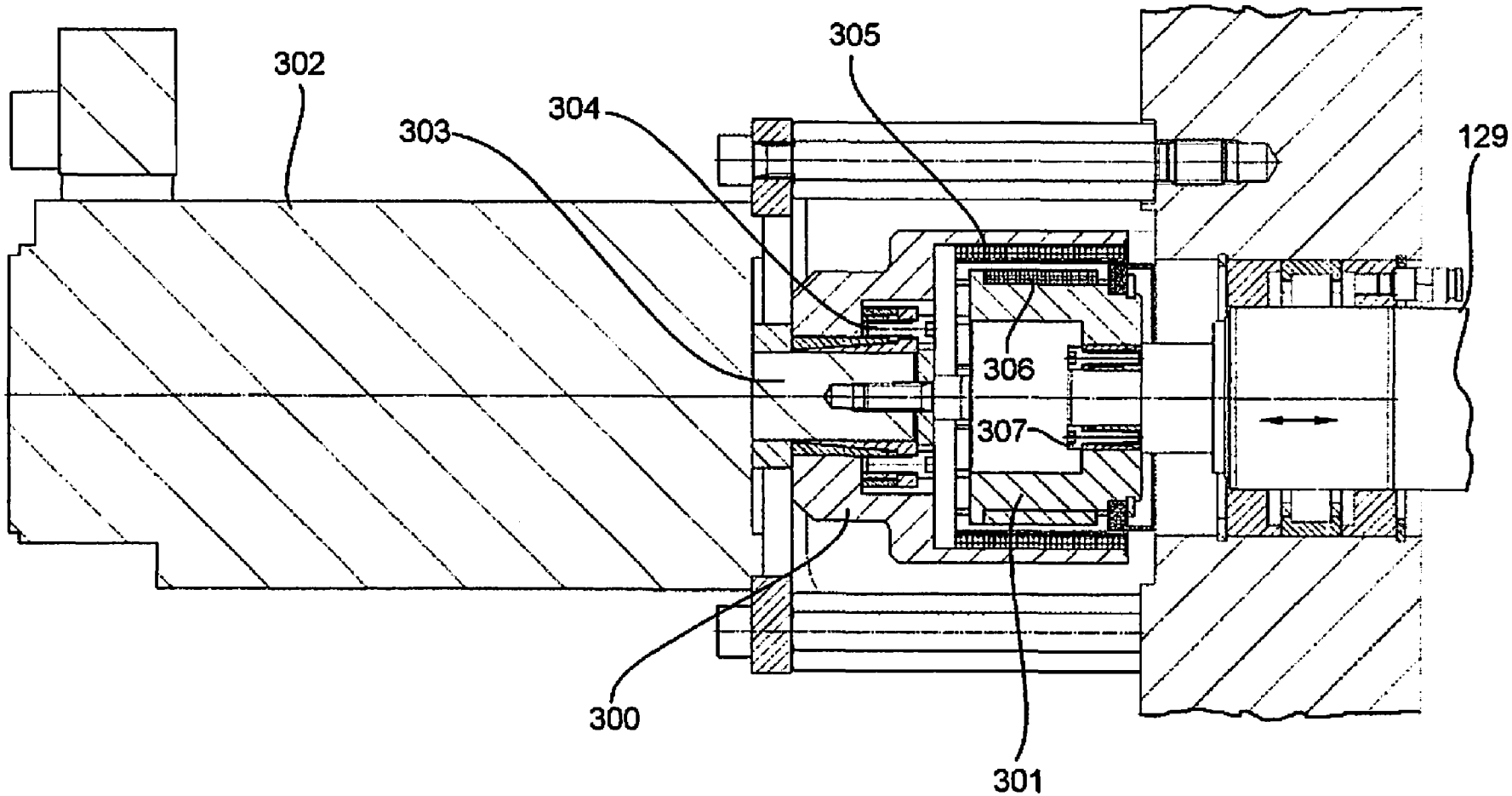
FIG. 4 a cross-sectional diagram of a device in a printing couple of a printing press, with a roller of the printing couple and with a magnetic coupling for transmitting torque and for receiving an oscillating stroke.

FIG. 4 shows a cross-sectional illustration of a device in a printing couple 101 of a printing press, with a chromium dampening fluid distribution roller 129 of the printing couple 101 having a magnetic coupling for transmitting torque from a drive assembly 302, such as, for example, a separate drive 302, and for receiving an oscillating stroke. The chromium dampening fluid distribution roller 129 is hard chromium plated. The separate rotational drive for the chromium dampening fluid distribution roller 129 or the dampening fluid distribution roller 129 of a printing couple 101 as shown in FIG. 1 or FIG. 2 is identified, as indicated above, by reference symbol 302.

The separate drive 302 is attached to the printing press, in a stationary manner, by the use of a bolted connection as shown in FIG. 4. The separate drive 302 drives the drive shaft 303, such as, for example, the motor shaft 303, which is, in turn, non-rotatably connected to the outer rotor 300 of the magnetic coupling. A clamp ring 304 is used to mount the outer rotor 300 on the motor shaft 303. This clamp ring 304 is inserted into a wheel seat of the outer rotor 300 and the outer rotor then is pushed onto the motor shaft or drive shaft 303. The clamp ring 304 is then aligned with the hub of the outer rotor 300, and finally, the tightening screws of the clamp ring 304 are tightened.

On its interior surface, the outer rotor 300 is equipped with permanent magnets 305, with north and south poles of these permanent magnets alternating in a circumferential direction.

The inner rotor 301 is also equipped on its exterior surface with permanent magnets 306, and also with their north and south poles alternating. This inner rotor 301 runs inside the outer rotor 300. The inner rotor 301 is connected, by a clamp ring 307, to the end of the chromium dampening fluid distribution roller 129 of the printing couple 101. The clamp ring 307 for the inner rotor 31 is mounted in the same manner as was described in reference to clamp ring 304, as is used for connecting motor shaft 303 and outer rotor 300.

Dampening fluid distribution roller 129 is placed in axially oscillating motion by an oscillating drive. The magnetic coupling, including outer rotor 300 and inner rotor 301, is able to accept the oscillating stroke generated in this manner because the relative position of outer rotor 300 and inner rotor 301 is variable rather than fixed. When the dampening fluid distribution roller 129 is in a first oscillating stroke position, outer rotor 300 and inner rotor 301 are arranged in a first position. When the dampening fluid distribution roller 129 is in a second oscillating stroke position, outer rotor 300 and inner rotor 301 are arranged in a second position, which is different from the first position. The oscillating stroke of the chromium dampening fluid distribution roller 129, which is indicated by the double arrow in FIG. 4, can thus be accepted by the magnetic coupling without contact, and therefore also free from wear and tear. Because it is free from any wear and tear, the magnetic coupling is also essentially maintenance free.

Figure 5:
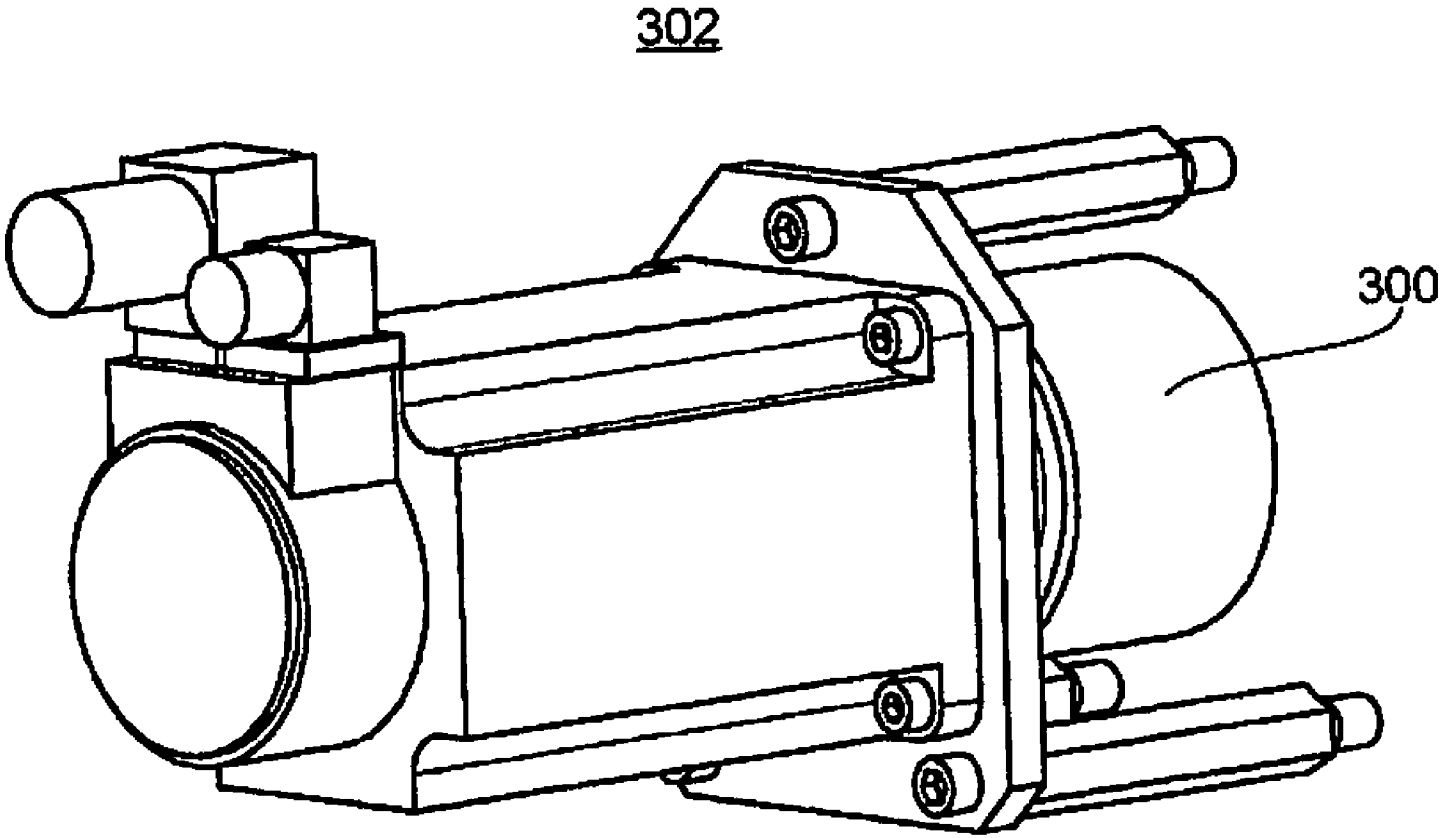
FIG. 5 a perspective view of the separate drive for driving the rotation of a roller of the printing couple, and including the outer rotor of the magnetic coupling.

FIG. 5 shows the separate drive 302 of the chromium dampening fluid distribution roller 129 from a perspective view. Also shown in FIG. 5 is the outer rotor 300 of the magnetic coupling, which is non-rotatably connected to the motor shaft 303, which itself is not specifically shown in FIG. 5.

Figure 6:
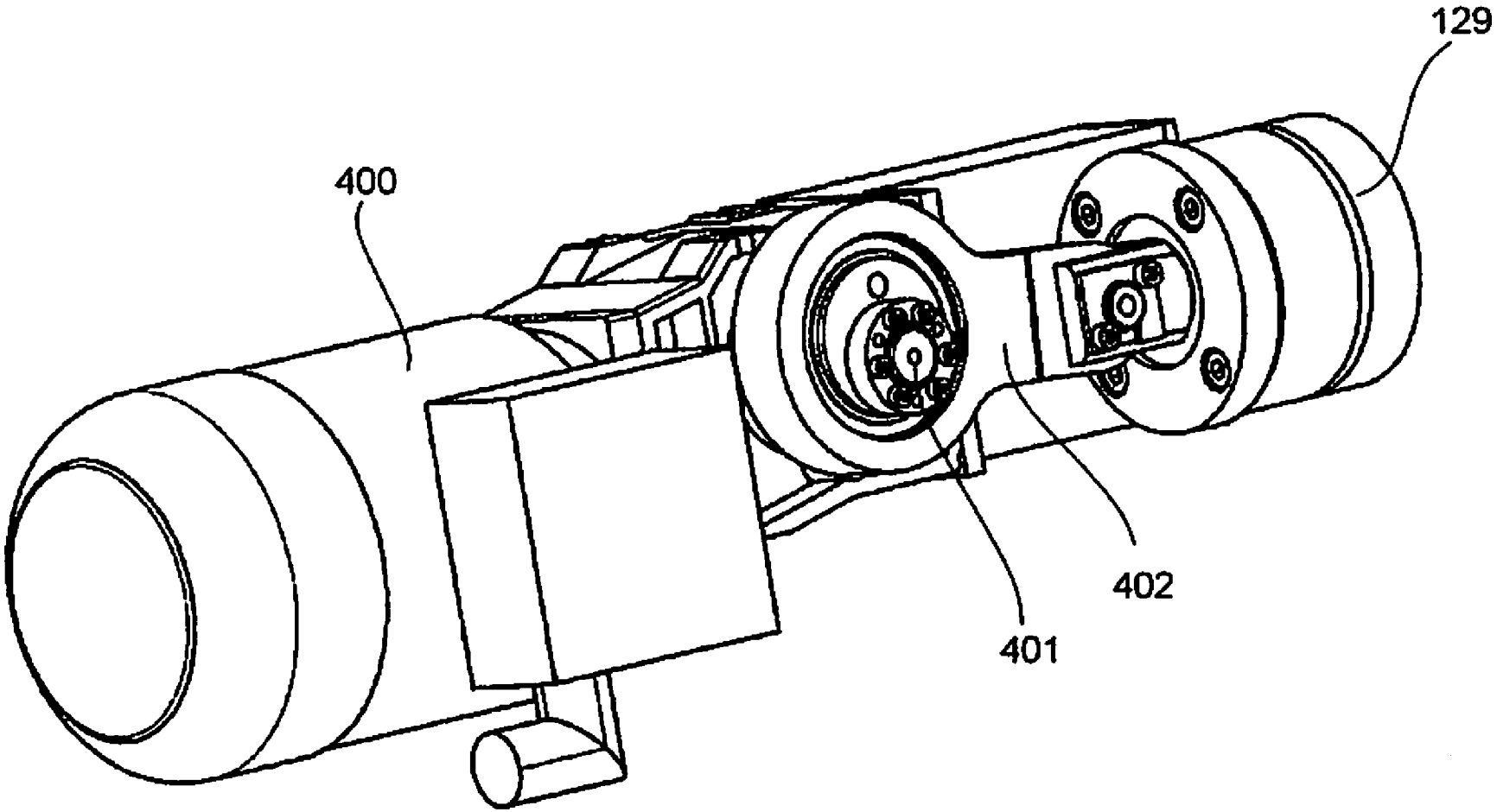
FIG. 6 a perspective view of the oscillating drive for use in effecting the oscillating stroke of a roller of the printing couple.

The frictional stroke of the chromium dampening fluid distribution roller 129 is introduced, for example, by the use of, for example, a crank mechanism which is shown in FIG. 6. The drive unit 400, which can be embodied as an electric motor 400, for example, rotates the eccentric 401 through a transmission mechanism that is not specifically shown in FIG. 6. The eccentric 401 drives the connector 402, which may be, for example, a connecting rod 402, which connecting rod 402 converts the rotational movement of the eccentric 401 to a linear movement of the dampening fluid distribution roller 129, such as, for example, to the oscillating stroke of the dampening fluid distribution roller 129.

In principle, other oscillating drives, which convert rotational movement of the roller to axially oscillating movement of the same roller are also possible. These oscillating drives may be configured, such as, for example, oscillating transmissions.

Figure 7:
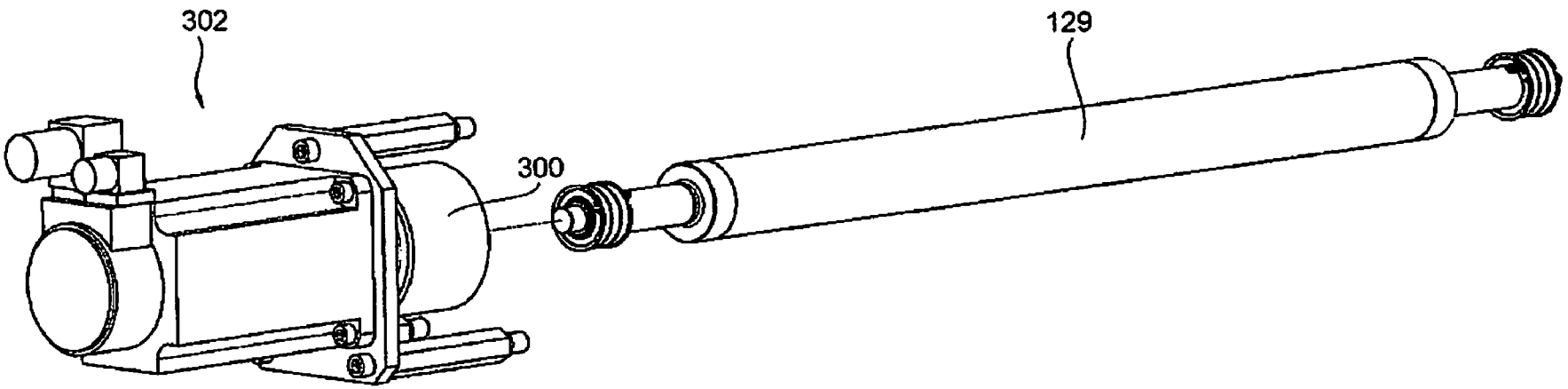
FIG. 7 an exploded perspective view of the separate drive of FIG. 6, with a roller of the printing couple.

FIG. 7 shows a perspective view of a device, in accordance with the present invention, and including a chromium dampening fluid distribution roller 129 and a drive assembly 302 for use in effecting the rotational movement of the chromium dampening fluid distribution roller 129. The drive assembly 302 consists of an electric motor 302, which can be embodied as a three-phase alternating current motor 302, and which may be speed adjustable or speed controlled, as discussed above. As was specified in greater detail above, the electric motor 302 drives the outer rotor 300 of the magnetic coupling through its motor shaft 303. Torque is transmitted from the electric motor 302 to the chromium dampening fluid distribution roller 129 through the inner rotor 301, which is not specifically shown in FIG. 7, which inner rotor 301 is non-rotatably connected to the chromium dampening fluid distribution roller 129.

The oscillating drive of the chromium dampening fluid distribution roller 129 is not shown in FIG. 7. Such an oscillating drive could be positioned, for example, on the opposite side of the chromium dampening fluid distribution roller 129 from the separate rotational drive 302, and could be embodied, for example, as an oscillating transmission or as a crank mechanism according to the depiction and discussion set forth above in connection with FIG. 6.

The electric motor 302 can be arranged coaxially relative to the rotational axis of the dampening fluid distribution roller 129.

The inner rotor 301 and the outer rotor 300 are capable of moving relative to one another in the direction of the rotational axis of the dampening fluid distribution roller 129.

Either inner rotor 301 or outer rotor 300 is arranged immovably in the direction of the rotational axis of the dampening fluid distribution roller 129.

The device in a printing couple 101 of a printing press with a magnetic bearing or with a magnetic coupling, in accordance with the present invention, is not limited to the chromium dampening fluid distribution roller 129 of the dampening unit 106. It can alternatively or additionally be used with other rollers, such as, for example, with the various rollers of the inking unit 105. Additionally, the device in a printing couple 101 of a printing press in accordance with the present invention is not limited to the embodiments of a printing couple 101 shown in FIG. 1 or 2 It may also be used in printing couples 101 having different structures.

A stand-alone rotational drive for the dampening fluid distribution roller 129 is preferably a drive that is mechanically independent at least from the other rollers. It typically has no positive drive connection such as, for example, by the use of toothed gears, to any rotational drive between roller 129 and the other rollers.

While a preferred embodiment of a device in a printing couple of a printing press, in accordance with the present invention, has been set forth hereinabove fully and completely, it will be apparent to one of skill in the art that various changes in, for example, the specific structure of the printing couples, the types of press frames used, the type of material web being printed, and the like, could be made without departing from the true spirit and scope of the present invention which is accordingly to be limited only by the appending claims.

What is claimed is:

1. A device in a printing couple (101) of a printing press comprising:

at least one roller (129) of at least one of an inking unit (105) and a dampening unit (106) of the printing couple (101) and having a roller rotational axis;

at least one oscillating drive and being usable to generate an axial oscillating stroke of the roller (129) in the direction of the roller rotational axis;

at least one rotary drive means (302) and being usable to generate a rotational movement of the at least one roller (129), the at least one rotary drive means (302) being embodied as one of an electric motor (302) and as including an electric motor (302); and a magnetic coupling arranged separate from said at least one rotary drive means, and positioned between said at least one roller (129) and said at least one rotary drive means (302), said magnetic coupling including an inner rotor and an outer rotor, the inner rotor being positioned inside the outer rotor, the inner rotor (301) and the outer rotor (300) being movable, relative to one another, in the direction of the rotational axis of the roller (129) to compensate for the axial oscillating stroke of the at least one roller generated by the at least one oscillating drive.

2. The device of claim 1, wherein the at least one rotary drive means (302) is embodied in the form of a separate drive (302) for rotationally driving the roller (129), and further wherein torque is transmitted from said at least one rotary drive means to the at least one roller (129) by the magnetic coupling.

3. The device of claim 1, wherein a relative position of the outer rotor (300) and inner rotor (301), with respect to each other is variable in the direction of the rotational axis of the at least one roller (129).

4. The device of claim 1, wherein, when the at least one roller (129) is in a first oscillating stroke position, the outer rotor (300) and the inner rotor (301) are arranged in a first position, and when the at least one roller (129) is in a second oscillating stroke position which is different from the first oscillating stroke position, the outer rotor (300) and the inner rotor (301) are arranged in a second position, which is different from the first position.

5. The device of claim 1, wherein the electric motor (302) is arranged coaxially in relation to the rotational axis of the at least one roller (129).

6. The device of claim 1, wherein the at least one roller (129) is embodied as a distribution roller (129) of the dampening unit (106) of the printing couple (101).

7. The device of claim 1, wherein the at least one roller (129) is embodied as a chromium roller (129), which cooperates with other dampening unit rollers (128; 130) of the dampening unit (106) which other dampening unit rollers each have a rubber-coated surface.

8. The device of claim 7, wherein the other dampening unit rollers (128; 130) consist of a dampening unit forme roller (128) for applying the of moisture to the forme cylinder (104) of the printing couple (101) and a dampening unit dipping roller (130) for taking up dampening agent from a dampening agent reservoir (132).

9. The device of claim 1, wherein the at least one roller (129) is the only roller (129) of the dampening unit (106) that is equipped with its own separate drive (302).

10. The device of 1, wherein the at least one rotary, drive means (302) has a drive shaft (303).

11. The device of claim 10, wherein the outer rotor (300) of the magnetic coupling is non-rotatably connected to the drive shaft (303).

12. The device of claim 10, wherein at least one of the outer rotor (300) is non-rotatably connected to the drive shaft (303) of the at least one rotary drive means (302) by a clamp ring (304), and the inner rotor (301) is non-rotatably connected to the at least one roller (129) by a clamp ring (307).

13. The device of claim 1, wherein either the inner rotor (301) or the outer rotor (300) is positioned as stationary in the direction of the rotational axis of the at least one roller (129).

14. The device of claim 1, wherein the inner rotor (301) is non-rotatably connected to the at least one roller (129).

15. The device of claim 1, wherein the at least one rotary drive means (302) is positioned stationary.

16. The device of claim 1, wherein the at least one oscillating drive is a crank mechanism.

17. The device of claim 16, wherein the crank mechanism comprises a drive unit (400) and an eccentric (401), which eccentric cooperates with a connecting rod (402), which connecting rod applies a force to the at least one roller (129), which force acts in the axial direction of the at least one roller (129).

18. The device of claim 1, wherein the at least one oscillating drive comprises an oscillating transmission, which oscillating transmission derives the axial oscillating stroke of the at least one roller from the rotational movement of the at least one roller (129).

19. The device of claim 1, wherein the dampening unit (106) comprises a dampening unit forme roller (128), which can be pivoted away from the forme cylinder (104) for washing.

20. The device of claim 1, wherein the at least one oscillating drive is arranged on an end surface of the at least one roller (129), which end surface is opposite the at least one rotary drive means (302).

21. The device of claim 1, wherein the at least one rotary roller (129) and other rollers in the printing couple have no shared rotational drive and are not in a positive drive connection.

* * * * *